US012495870B1

(12) United States Patent
Zhu

(10) Patent No.: US 12,495,870 B1
(45) Date of Patent: Dec. 16, 2025

(54) BELT BUCKLE AND BELT

(71) Applicant: Yabing Zhu, Fujian (CN)

(72) Inventor: Yabing Zhu, Fujian (CN)

( * ) Notice: Subject to any disclaimer, the term of this patent is extended or adjusted under 35 U.S.C. 154(b) by 0 days.

(21) Appl. No.: 19/052,153

(22) Filed: Feb. 12, 2025

(51) Int. Cl.
*A44B 11/12* (2006.01)

(52) U.S. Cl.
CPC ..... *A44B 11/12* (2013.01)

(58) Field of Classification Search
CPC ..... A44B 11/12
See application file for complete search history.

(56) References Cited

U.S. PATENT DOCUMENTS 1,087,065 A * 2/1914 Kaiser ..... A44B 11/12 24/170
4,419,792 A * 12/1983 Kohli ..... A44B 11/24 24/191
4,669,155 A * 6/1987 Chen ..... A41F 9/002 24/191
5,572,747 A * 11/1996 Cheng ..... A44B 11/12 2/322
8,256,067 B2 * 9/2012 Kunst ..... A44B 11/06 24/168
10,966,489 B2 * 4/2021 Rowland ..... A41F 9/002
11,950,663 B1 * 4/2024 Rowland ..... A44B 11/16
2012/0325164 A1 * 12/2012 Finlan ..... A01K 27/001 119/863
2015/0175050 A1 * 6/2015 Eenigenburg ..... B60P 7/0838 24/69 CT
2023/0415696 A1 * 12/2023 Coffman ..... B60R 22/30
2024/0057726 A1 * 2/2024 Chen ..... A44B 11/12

* cited by examiner

*Primary Examiner* — David M Upchurch
(74) *Attorney, Agent, or Firm* — Hawaii Patent Services; Nathaniel K. Fedde; Kenton N. Fedde

(57) ABSTRACT

The present disclosure provides a belt buckle and a belt, comprising a body and a locking mechanism, wherein the body is provided with a connecting part for fixing the fixed end of a belt; the locking mechanism comprises a locking lever for adjusting the pressure on the surface of the belt through self-rotation, the locking lever is provided with an adjusting part for squeezing the belt, both ends of the adjusting part are provided with rotating shafts by which the adjusting part can rotate by itself on the body, and the rotating shafts are eccentrically arranged on the end faces of the adjusting part.

9 Claims, 6 Drawing Sheets

BELT BUCKLE AND BELT

TECHNICAL FIELD

The present disclosure relates to the technical field of belt fasteners, particularly to a belt buckle and a belt.

BACKGROUND

In modern times, belts have become a fashion. Looking closely at international fashion shows, designers can't live without belts, especially men. Almost every man has to tie a belt on his pants. The role of belts has been extended to fashion collocation beyond practicality, and even the significance of embellishment has become increasingly prominent. Some international brands have also made great efforts on their belts, and every season they will launch meaningful new models, or use new materials or apply new ideas.

Belt buckle, also known as belt head and buckle head, is an indispensable part of the belt, which is used to fix and tighten the belt and prevent the belt from slipping off. However, the current belt buckles are mainly divided into two types: needle buckles and sliding buckles. Because the needle buckles have gaps, they cannot fit the body well, and some people need to manually add needle buckles, so this type of belt buckles is complicated in structure and inconvenient to operate. The existing sliding buckle is simpler than the pin buckle structure, but the distance between the locking structure of the belt buckle and the belt is fixed. After long-term use, the surface of the locking structure becomes smooth, and when the belt is tensioned, it cannot self-lock, which makes the belt slip and affect the normal use.

Therefore, there is a need to put forward a new type of belt buckle and belt to solve the above problems.

SUMMARY

The present disclosure provides a belt buckle and a belt to solve the problems raised by the above background technology.

In order to achieve the object of the present disclosure, the present disclosure adopts the following technical solutions:

A belt buckle includes a body provided with a connecting part for fixing a fixed end of a belt; and a locking mechanism comprising a locking lever for adjusting a pressure on a surface of the belt by self-rotation so as to adjust a locking state of the belt, wherein the locking lever is provided with an adjusting part for squeezing the belt, two ends of the adjusting part are provided with rotating shafts by which the adjusting part can rotate by itself on the body, and the rotating shafts are eccentrically arranged on end faces of the adjusting part, so that when the adjusting part is at an angle of squeezing the belt, the rotating shafts are eccentric to a side adjacent to a head end of the body.

The present disclosure further provides a gear belt buckle, which includes a body, wherein a locking set is rotatably connected in the body, and the body and the locking set are rotatably connected through an eccentric shaft; and at least one group of locking and clamping structures are arranged between the eccentric shaft and the locking set, and the locking and clamping structures are configured for further limiting the eccentric shaft from generating relative rotation with the body after the locking set locks the belt.

The present disclosure further provides a belt buckle, which includes a body that is provided with a connecting part for fixing a fixed end of a belt; and a locking mechanism comprising a locking lever configured for adjusting a pressure on a surface of the belt through self-rotation so as to adjust a locking state of the belt, wherein the locking lever is provided with an adjusting part configured for squeezing the belt; and two ends of the adjusting part are provided with rotating shafts by which the adjusting part can rotate by itself on the body, and the rotating shafts are eccentrically arranged on end faces of the adjusting part, so that when the adjusting part is at an angle of squeezing the belt, the rotating shafts are eccentric to a side adjacent to a head end of the body; and the rotating shafts are provided with turning buttons outside the body.

BRIEF DESCRIPTION OF DRAWINGS

The drawings, which constitute a part of this application, are used to provide a further understanding of the present disclosure, and the illustrative embodiments of the present disclosure and the description thereof are used to explain the present disclosure, and do not constitute undue limitations on the present disclosure. In the drawings.

Figure 1:
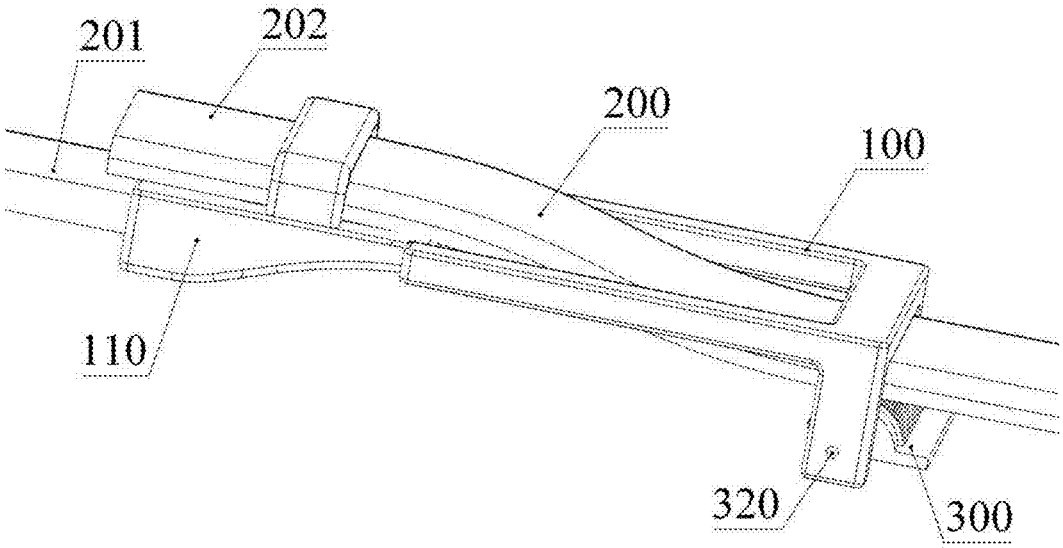
FIG. 1 is a structural schematic diagram of the present disclosure.
Figure 2:
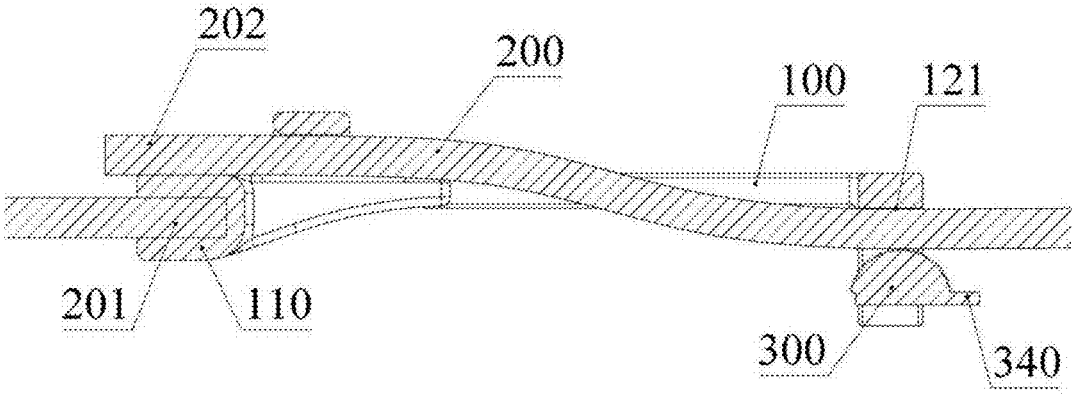
FIG. 2 is a sectional view of the locked state of the present disclosure.
Figure 3:
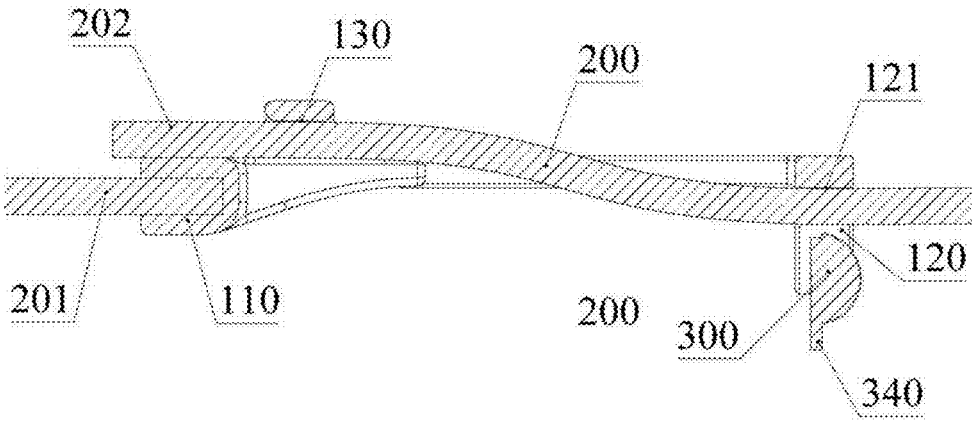
FIG. 3 is a sectional view of the unlocked state of the present disclosure.

Reference signs: Body (100); Connecting part (110); Inlet (120); Blocking part (121); Outlet (130); Belt (200); Fixed end (201); Free end (202); Locking lever (300); Adjusting part (310); Rotating shaft (320); Anti-slip area (330); Convex part (340); Groove (350); Turning button (360); Supporting frame (400); Accommodating cavity (410); Clamping structure (420); Locking block (500); Eccentric shaft (510); Clamping groove (511); Rotating groove (520); Sliding groove (530); Anti-dropping piece (540); Locking tooth (600); Sliding block (610); Rotating block (700); Plug-in block (710); Unlocking piece (720); Locking block (730); Elastic member (800).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

As shown in FIGS. 1-7, a belt buckle includes a body 100, and the body 100 is provided with a connecting part 110 for fixing the fixed end 201 of a belt 200. the head end of the body 100 is provided with an inlet 120 for the free end 202 of the belt 200 to pass through, the middle part of the body 100 is a frame through which the belt 200 can pass, and the tail part of the body 100 is provided with an outlet 130 for the free end 202 of the belt 200 to pass through to form a closed ring. The fixed end 201 of the belt 200 is one end for fixing the belt buckle, and the free end 202 is the other end that can be freely pulled. The belt buckle further includes a locking mechanism, which includes a locking lever 300 for adjusting the pressure on the surface of the belt 200 through self-rotation, and the locking lever 300 is provided with an adjusting part 310 for squeezing the belt 200 and rotating shafts 320 at both ends of the adjusting part 310, wherein the rotating shafts 320 are eccentrically arranged at the ends of the adjusting part 310, and the cross section of the adjusting part 310 is semicircular, so that when the adjusting part 310 is at an angle of squeezing the belt 200, the rotating shafts 320 are eccentric to the side adjacent to the head end of the body 100, and its arc-shaped outer surface is used to contact with the inner side of the belt 200. The belt buckle further includes a blocking part 121 arranged opposite to the locking lever 300, and used for supporting the belt 200 when the adjusting part 310 squeezes the belt 200.

Please refer to FIG. 2 to FIG. 5, in this embodiment, the locking lever 300 is a semi-circular lever, and the rotating shafts 320 are eccentrically arranged at both ends of the locking lever 300, so that the cross section of the adjusting part 310 presents an eccentric wheel structure. When the outer edge of the adjusting part 310 is facing the inner surface of the belt 200, the rotating shafts 320 are located at the ends of the locking lever 300 adjacent to the head end of the body 100. With this structural arrangement, when the locking lever 300 rotates clockwise and gradually clings to the belt 200, the locking space between the adjusting part 310 and the blocking part 121 gradually becomes smaller, so that the belt 200 realizes the self-locking function. After the adjusting part 310 engages the belt 200, the required rotation angle is very small, that is, the effective area range of the adjusting part 310 for engaging the belt 200 is small, therefore setting the cross section of the locking lever 300 into a semicircle can not only save space, but also reduce the cost, and the plane side of the adjusting part 310 is convenient to control its rotation.

Please refer to FIG. 2 to FIG. 5, in this embodiment, there is a certain gap between the locking lever 300 and the blocking part 121, thus forming a locking space for the belt 200 to pass through. When the belt needs to be fastened, the free end 202 of the belt 200 first passes through the locking space, and then the locking lever 300 is rotated clockwise. With the eccentric rotation of the locking lever 300, the distance between the outer surface of the adjusting part 310 and the blocking part 121 gradually decreases, that is, the locking space gradually decreases, so that the pressing force exerted by the adjusting part 310 on the surface of the belt 200 gradually increases, thereby clamping the belt 200 between the adjusting part 310 and the blocking part 121. When the tension of the belt 200 increases, it will drive the locking lever 300 to be subjected to a pulling force to continue to rotate clockwise, thus further enhancing the squeezing force between the adjusting part 310 and the belt 200 and realizing the self-locking effect of the belt 200. Because the distance between the adjusting part 310 and the blocking part 121 is reduced with the tension of the belt 200, even if the roughness of the inner side of the belt 200 and the surface of the adjusting part 310 decreases due to long-term use, it can be compensated by this self-locking structure, which effectively solves the problem of the belt 200 slipping and makes the belt safer and more durable.

When it is necessary to loosen the belt 200, as long as the free end 202 of the belt 200 is pulled in the threading direction, that is, the direction of tightening the belt 200, the locking lever 300 can be driven to rotate counterclockwise, so that the locking space becomes larger, and the belt 200 can be pulled out from between the locking lever 300 and the blocking part 121.

Figure 4:
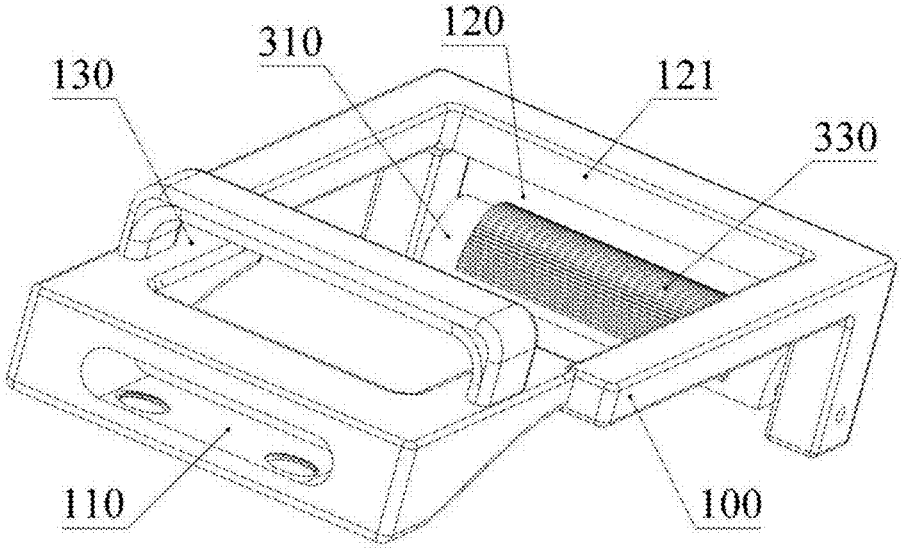
FIG. 4 is a schematic structural view from another perspective of the present disclosure.
Figure 5:
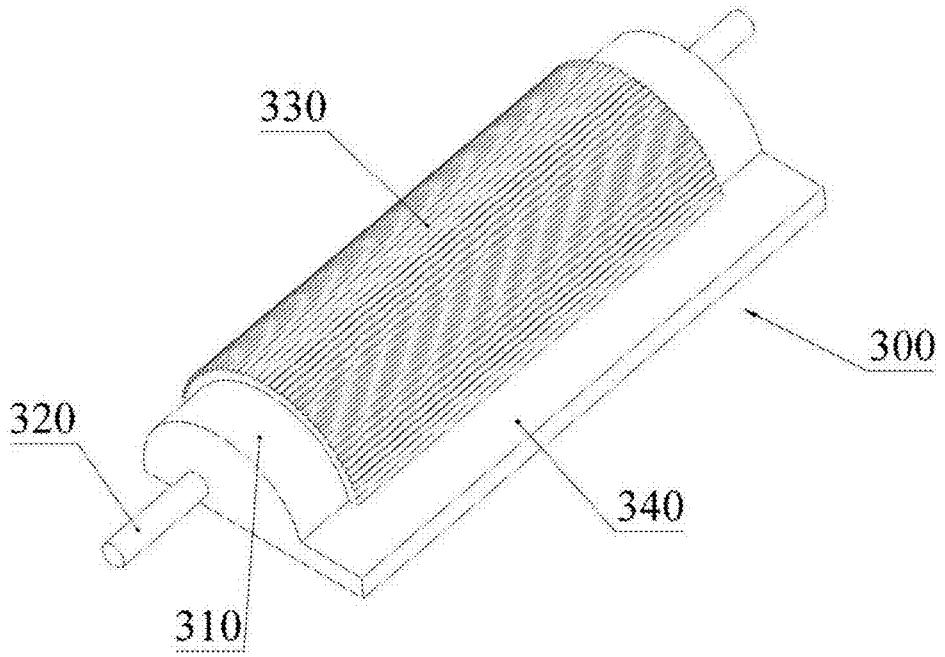
FIG. 5 is a schematic structural view of the locking lever of the present disclosure.

Please refer to FIGS. 4 and 5, in this embodiment, the blocking part 121 is arranged on one side of the outer surface of the belt 200, and the locking lever 300 is arranged on one side of the inner surface of the belt 200. This arrangement prevents the locking lever 300 from wearing the outer surface of the belt 200 and affecting the appearance of the belt. In order to increase the friction force between the surface of the adjusting part 310 and the inner side of the belt 200, the surface of the adjusting part 310 is also provided with an anti-slip area 330. In this embodiment, a plurality of toothed racks in the form of strip protrusions are distributed on the surface of the anti-slip area 330, the toothed racks extend along the axial direction of the locking lever 300, and the toothed racks can be distributed in parallel or cross each other.

In other embodiments (not shown in the figure), the anti-slip area 330 on the surface of the adjusting part 310 can be cancelled, and the surface of the adjusting part 310 can be directly abutted against the inner surface of the belt 200. The smooth surface can prevent the abrasion on the inner surface of the belt 200 from being effectively reduced, and the anti-slip coating can be sprayed on the surface of the adjusting part 310 to enhance the friction force. This coating is usually composed of a special high-friction material, and the surface of the adjusting part 310 can be evenly covered by spraying or coating process to enhance the friction force and achieve an anti-slip effect.

In other embodiments (not shown in the figure), the surface of the anti-slip area 330 can also adopt other structures for increasing roughness, such as a plurality of bumps distributed on the surface of the anti-slip area 330 or doping bumps between adjacent racks. There are still more examples of this anti-slip structure, which is not exhaustive here.

Please refer to FIGS. 1 to 5, in this embodiment, the tail end of the body 100 is further provided with an outlet 130 for the tail end of the belt 200 to pass through, and the locking lever 300 is arranged at the inlet 120 of the body 100.

In other embodiments (not shown in the figure), the locking lever 300 can be arranged at the outlet 130, and can also be arranged at any position between the inlet 120 and the outlet 130, as long as the locking lever 300 is arranged opposite to the blocking part 121. When the locking lever 300 is arranged at the outlet 130, the inside of the outlet 130 serves as the blocking part 121; when the locking lever 300 is arranged between the inlet 120 and the outlet 130, the blocking part 121 needs to be arranged on the frame; when the locking lever 300 is arranged at the inlet 120, the locking space between the blocking part 121 and the locking lever 300 also serves as the inlet 120; when the locking lever 300 is arranged between the outlet 130 and the inlet 120, the inlet 120 for binding the head end of the belt 200 is separately arranged at the head end of the body 100.

Please refer to FIGS. 4 and 5, in this embodiment, the anti-slip area 330 is located in the middle area of the locking lever 300, and there is a certain distance between the boundaries at both ends of the anti-slip area 330 and the inner walls at both sides of the body 100, forming a gap to avoid the edge of the belt 200. There are many kinds of existing belts 200. Some belts 200 are filled with interlayer in order to enhance aesthetic feeling and comfort, and the two sides of the belt 200 are stitched, so that stitches are formed on the two sides of the belt 200. In order to prevent the adjusting part 310 from wearing the stitches on the two sides of the belt 200, the width of the anti-slip area 330 is smaller than that of the belt 200, and the anti-slip area 330 can only touch the middle area inside the belt 200, but not the edge of the belt 200, thus avoiding seam abrasion at the edge of the belt 200.

Please refer to FIGS. 2 to 5, in this embodiment, in order to facilitate manual rotation of the locking lever 300, there is also an operating part at one end of the outer edge of the adjusting part 310 away from the rotating shaft 320. The operating part is a convex part 340 protruding from the surface of the adjusting part 310, which is strip-shaped as a whole and extends along the axial direction of the locking lever 300. The locking lever 300 can be controlled to rotate clockwise or counterclockwise by toggling the convex part 340 with a finger.

In order to ensure the smooth unlocking of the belt, the distance from the semi-circular surface of the adjusting part 310 near the rotating shaft 320 to the blocking part 121 is greater than the thickness of the belt, so that the adjusting part 310 can be separated from the inner surface of the belt 200 after the locking lever 300 rotates counterclockwise to a certain angle; similarly, in order to improve the reliable self-locking function when the belt is tightened, when the locking lever 300 rotates clockwise to a certain angle, the distance from the end of the semicircular surface of the adjusting part 310 far from the rotating shaft 320 to the blocking part 121 is smaller than the thickness of the belt 200, and with the increase of the pulling force of the belt 200 in the pulling direction, the distance between the surface of the adjusting part 310 and the blocking part 121 is further reduced, and the anti-slip area 330 is more deeply engaged.

Figure 7:
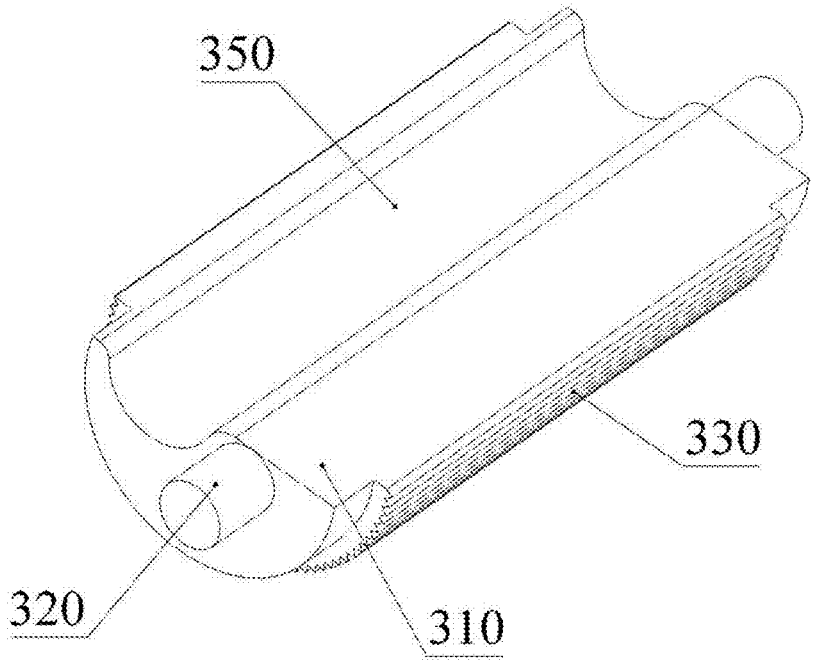
FIG. 7 is a structural schematic diagram of another embodiment of the locking lever of the present disclosure.

Please refer to FIG. 7, in another embodiment, the operating part may be a groove 350 formed inside the adjusting part 310, and the groove 350 is located at one end inside the adjusting part 310 (the plane side) far from the rotating shaft 320. The locking lever 300 can be controlled to rotate clockwise or counterclockwise by toggling the groove 350 with a finger.

Figure 6:
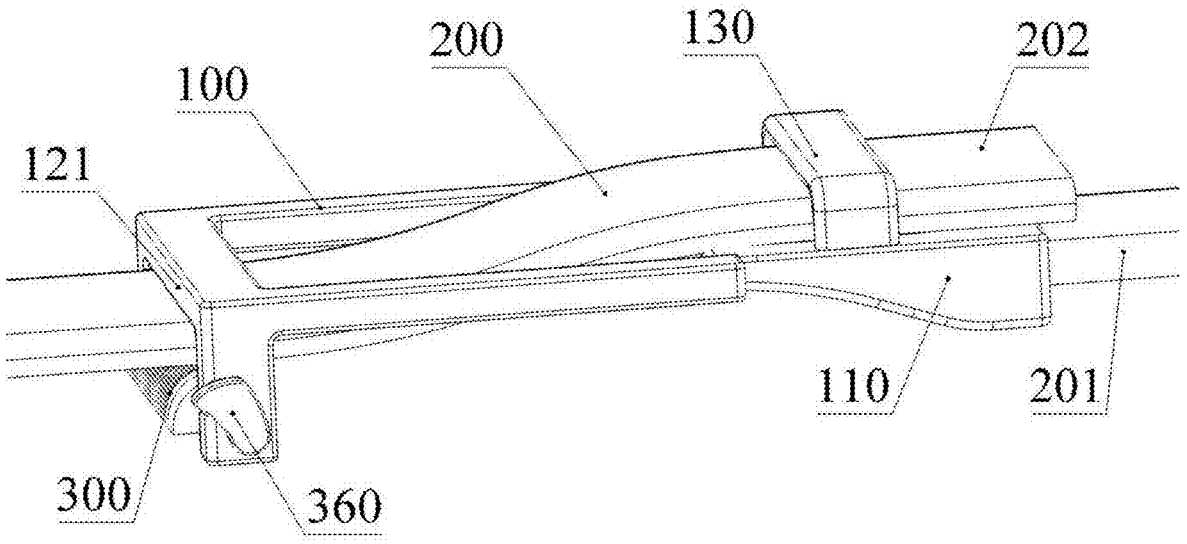
FIG. 6 is a structural schematic diagram of another embodiment of the locking lever of the present disclosure.

Please refer to FIG. 6, in an embodiment of the present disclosure, the difference between this embodiment and the above-mentioned embodiment is that the operating part of the adjusting part 310 is cancelled, and the turning button 360 is arranged outside the body 100 on the rotating shaft 320, so that the adjusting part 310 can be controlled by toggling the turning button 360; the turning button 360 is arranged outside the body 100, so that the user can adjust the adjusting part 310 without touching the inside of the adjusting part 310, thus optimizing the operation angle of the hand, further improving the use experience, and reducing the difficulties caused by limited space or inconvenient operation.

Figure 8:
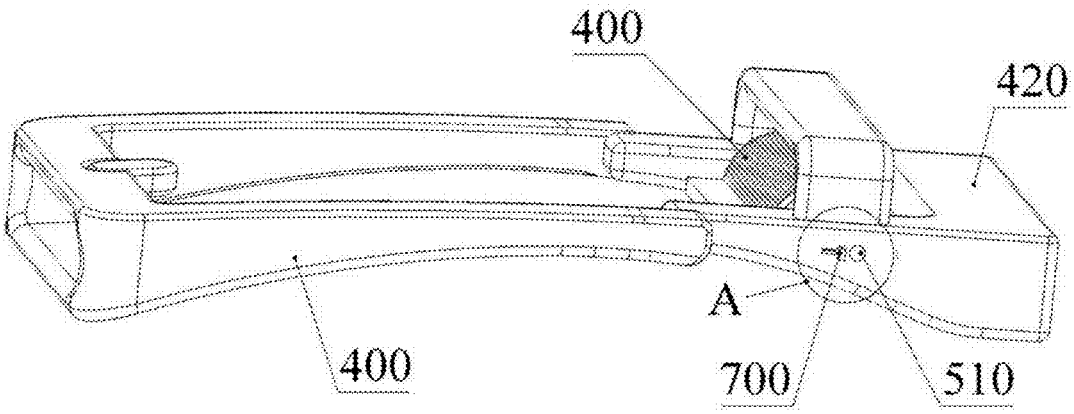
FIG. 8 is a structural schematic diagram of another embodiment of the present disclosure.
Figure 9:
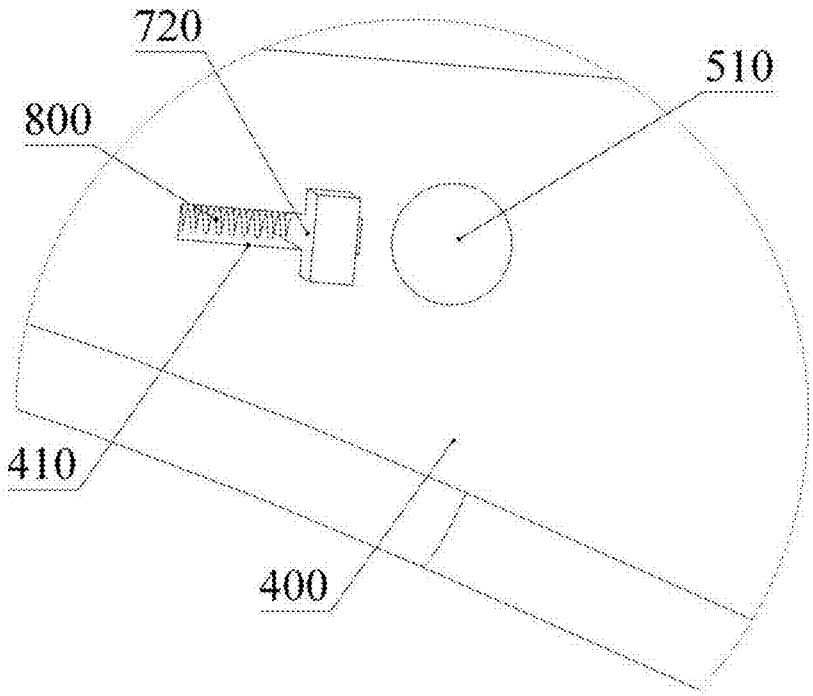
FIG. 9 is a partial enlarged view at A of the present disclosure.
Figure 10:
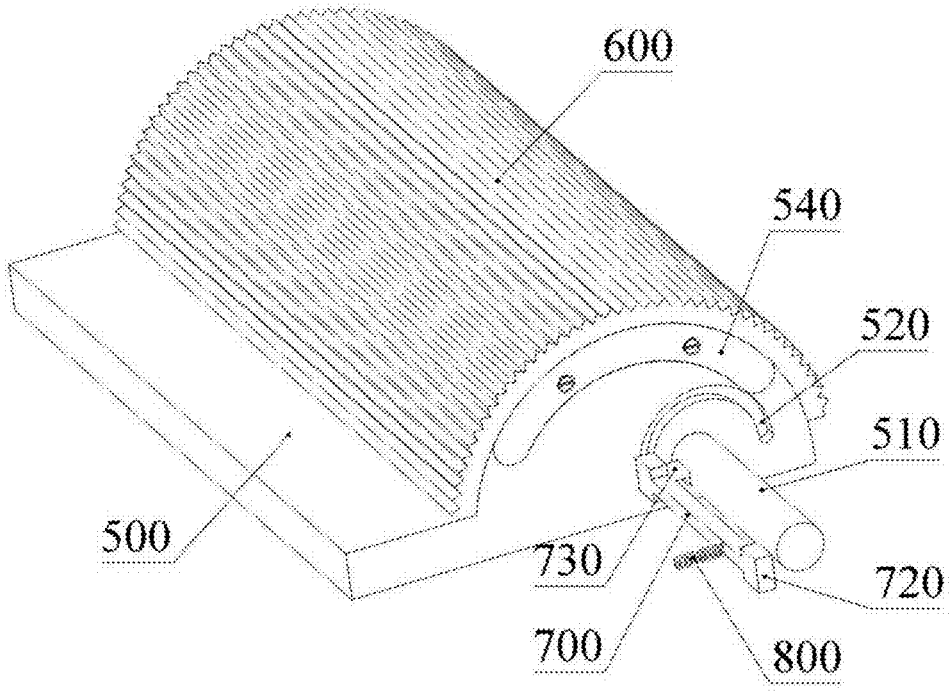
FIG. 10 is a schematic structural diagram of the locking set of the present disclosure.
Figure 11:
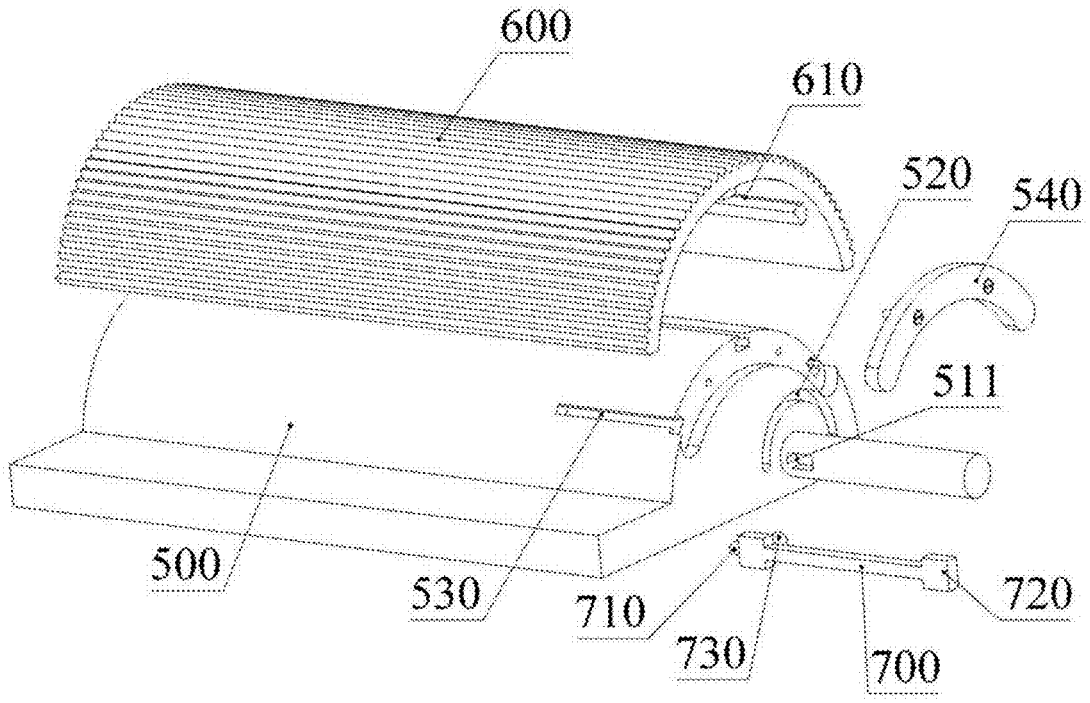
FIG. 11 is an exploded view of the locking set of the present disclosure.

Please refer to FIG. 8 and FIG. 11, in this embodiment, one end of the supporting frame 400 is provided with a clamping structure 420, the fixed end 201 of the belt 200 is fixed in the clamping structure 420, a locking set is rotatably connected in the supporting frame 400, and the supporting frame 400 and the locking set are rotatably connected through an eccentric shaft 510. A group of locking and clamping structures 420 are arranged between the eccentric shaft 510 and the locking set. The locking and clamping structure 420 is used to further restrict the eccentric shaft 510 from rotating relative to the supporting frame 400 after the locking set locks the belt, which can prevent the locking set from loosening when subjected to external force, and improve the reliability and durability of the belt buckle.

The locking set includes a locking block 500 and locking teeth 600 detachably connected with the locking block 500, one side of the locking block 500 is flat, and the other side is semi-circular curved surface. The locking teeth 600 are installed on one side of the semi-circular curved surface of the locking block 500, and the locking teeth 600 are also semi-circular. The locking block 500 is provided with a sliding groove 530, and the locking teeth 600 are provided with a sliding block 610 fitted with the sliding groove 530. The number of sliding blocks 610 is set corresponding to the sliding grooves 530, and there is no specific restriction on the number of sliding grooves 530 and sliding blocks 610, but it is preferably three. One side of the locking block 500 is detachably connected with the anti-dropping piece 540. When installing the locking teeth 600, the sliding block 610 is aligned with the sliding groove 530 and pushed into the sliding groove 530 in the horizontal direction until the sliding block 610 is completely positioned at the bottom of the sliding groove 530. Then, the anti-dropping piece 540 is installed on the locking block 500, and it is firmly fixed by screws. At this time, the anti-dropping piece 540 abuts against the sliding block 610 to prevent the locking tooth 600 from sliding off from the locking block 500 due to external force. The detachable locking teeth 600 make them replaceable. In the long-term use process, the contact surface of the locking teeth 600 may be worn due to friction, which will affect the locking effect. Through the detachable design, the user can replace the new locking teeth 600 after the locking teeth 600 are worn, thus restoring the locking performance. The user can also replace the locking teeth 600 with different surface characteristics according to different needs.

The locking and clamping structure 420 includes a rotating block 700 arranged inside the supporting frame 400, and the rotating block 700 is connected with the supporting frame 400 in a sliding manner. One side of the rotating block 700 is provided with a plug-in block 710, the locking block 500 is provided with a rotating groove 520, and the rotating groove 520 is fitted with the rotating groove 520. The inner diameter of the rotating groove 520 is larger than that of the plug-in block 710, and the rotating groove 520 is arc-shaped and eccentrically arranged around an eccentric rod. The rotating block 700 can rotate around the eccentric shaft 510 in the rotating groove 520 through the plug-in block 710. A locking block 730 is arranged on one side of the rotating block 700 near the eccentric shaft 510, a clamping groove 511 for accommodating the locking block 730 is arranged on the eccentric shaft 510, and an accommodating cavity 410 is arranged on the supporting frame 400. The rotating block 700 at least partially penetrates out of the supporting frame 400, and is fixedly connected to an unlocking piece 720. The accommodating cavity 410 is also provided with an elastic member 800, which is arranged between the rotating block 700 and the supporting frame 400, and the elastic member 800 is a compression spring.

Please refer to FIG. 8-FIG. 11, in this embodiment, when the belt buckle is in the locked state, the locking block 730 is inserted into the clamping groove 511, and the eccentric shaft 510 is in the locked state. At this time, the locking block 500 is fixed and cannot rotate, thereby ensuring that the belt buckle will not be accidentally unlocked due to external force, vibration and other factors during use. When unlocking is needed, the unlocking piece 720 is moved towards the compression spring, and the rotating block 700 begins to slide, the compression spring is compressed, and the locking block 730 gradually disengages from the clamping groove 511. At the same time, the rotating block 700 is capable of driving the locking block 500 to rotate slightly outward by the rotating groove 520. The eccentrically arranged rotating groove 520 enables the locking block 730 to gradually move away from the eccentric shaft 510, and at this time, the eccentric shaft 510 is in an unlocked state, and the locking block 500 can be rotated to unlock the belt buckle. Once again, the locking block 500 rotates to the locking state, and at this time, the clamping groove 511 is opposite to the locking block 730, the compression spring pushes the rotating block 700 to reset, and the locking block 730 is inserted into the clamping groove 511 to lock the eccentric shaft 510 again, so as to ensure that the belt buckle will not be accidentally unlocked due to external force, vibration and other factors.

In other embodiments (not shown in the figure), the elastic member 800 can also use elastic telescopic rod, spring leaf, rubber pad and magnetic rebound to achieve resilience, and a suitable elastic member 800 can be selected to achieve the reset function according to actual needs.

In conclusion, as can be seen from the above description, the present disclosure has achieved the following technical effects:

According to the belt buckle and the belt provided by the present disclosure, the locking lever 300 of the belt buckle is arranged in an eccentric structure, and when the belt 200 is tensioned, the locking lever 300 is driven to rotate in the direction of squeezing the belt 200, so that the distance between the adjusting part 310 and the inner side of the belt 200 is reduced, thereby increasing the squeezing force between the adjusting part 310 and the belt 200, and the self-locking of the belt buckle can be realized even if the roughness of the surface of the adjusting part 310 decreases; when it is necessary to loosen the belt 200, it only needs to pull the belt 200 in the tightening direction, so as to drive the locking lever 300 to reverse, reduce the pressing force between the adjusting part 310 and the surface of the belt 200, and facilitate the belt 200 to be pulled out; the structure is simple and the operation is convenient, so that the belt 200 has a reliable self-locking function when in use.

In the description of the present disclosure, it should be appreciated that the orientation or positional relationship indicated by orientation words such as "front, back, upper, lower, left, right", "lateral, vertical, horizontal" and "top, bottom" are usually based on the orientation or positional relationship shown in the attached drawings, just for the convenience of describing the present disclosure and simplifying the description. Unless otherwise stated, these orientation words do not indicate or imply that the device or element referred to must have a specific orientation or be constructed and operated in a specific orientation, therefore they cannot be construed as limiting the scope of protection of the present disclosure. The orientation words "inside and outside" refer to the inside and outside relative to the outline of each component itself.

For the convenience of description, spatially relative terms such as "above", "on", "on the upper surface of" and "upper" can be used here to describe the spatial positional relationship between a device or feature as shown in the drawings and other devices or features. It should be appreciated that spatially relative terms are intended to encompass different orientations in use or operation in addition to the orientation of the device depicted in the drawings. For example, if the devices in the drawings are inverted, devices described as "above" or "on" other devices or structures will be positioned as "below" or "under" other devices or structures. Thus, the exemplary term "above" can include both orientation of "above" and "below". The device can also be positioned in other different ways (rotated by 90 degrees or in other orientations), and the spatial relative description used here is explained accordingly.

In addition, it should be noted that the words "first" and "second" are used to define parts for the convenience of distinguishing the corresponding parts. Unless otherwise stated, the above words have no special meaning, and thus they cannot be construed as limiting the protection scope of the present disclosure.

What has been described above is only the preferred embodiment of the present disclosure, and it is not intended to limit the present disclosure. For those skilled in the art, the present disclosure may have various modifications and changes. Any modification, equivalent substitution, improvement and the like made within the spirit and principle of the present disclosure shall fall into the protection scope of the present disclosure.

What is claimed is:

1. A belt buckle, comprising:

a body provided with a connecting part for fixing a fixed end of a belt; and a locking mechanism comprising a locking lever for adjusting a pressure on a surface of the belt by self-rotation so as to adjust a locking state of the belt, wherein the locking lever is provided with an adjusting part with an outer surface configured for contacting and squeezing the belt;

wherein the locking mechanism further comprises a blocking part for supporting the belt when the adjusting part squeezes the belt, and the blocking part is arranged opposite to the locking lever;

wherein two ends of the adjusting part are provided with rotating shafts by which the adjusting part can rotate relative to the body, and the rotating shafts are eccentrically arranged on end faces of the adjusting part such that distances from the rotating shafts to respective contact portions of the outer surface are different and rotation of the adjusting part about the rotating shafts results in the respective contact portions of the outer surface facing the blocking part at different respective rotation angles of the adjusting part and with different engagement depths relative to the blocking part.

2. A belt buckle, comprising:

a body provided with a connecting part for fixing a fixed end of a belt; and a locking mechanism comprising a locking lever for adjusting a pressure on a surface of the belt by self-rotation so as to adjust a locking state of the belt, wherein the locking lever is provided with an adjusting part for squeezing the belt;

wherein the locking mechanism further comprises a blocking part for supporting the belt when the adjusting part squeezes the belt, and the blocking part is arranged opposite to the locking lever;

wherein two ends of the adjusting part are provided with rotating shafts by which the adjusting part is rotatable relative to the body, and the rotating shafts are on end faces of the adjusting part and are eccentrically arranged relative to an outer surface of the adjusting part such that when the adjusting part rotates from an angle that is not squeezing the belt to an angle of squeezing the belt, a distance between the outer surface of the adjusting part and the blocking part decreases; and wherein a radial cross section of the adjusting part is a semicircle, one side of the adjusting part for contacting the belt is an arc surface of the semicircle, and another side of the adjusting part is a plane.

3. The belt buckle according to claim 1, wherein the outer surface of the adjusting part is provided with an anti-slip area for increasing friction.

4. A belt buckle, comprising:

a body provided with a connecting part for fixing a fixed end of a belt; and a locking mechanism comprising a locking lever for adjusting a pressure on a surface of the belt by self-rotation so as to adjust a locking state of the belt, wherein the locking lever is provided with an adjusting part for squeezing the belt;

wherein the locking mechanism further comprises a blocking part for supporting the belt when the adjusting part squeezes the belt, and the blocking part is arranged opposite to the locking lever;

wherein two ends of the adjusting part are provided with rotating shafts by which the adjusting part is rotatable relative to the body, and the rotating shafts are on end faces of the adjusting part and are eccentrically arranged relative to an outer surface of the adjusting part such that when the adjusting part rotates from an angle that is not squeezing the belt to an angle of squeezing the belt, a distance between the outer surface of the adjusting part and the blocking part decreases; and wherein the outer surface of the adjusting part comprises an anti-slip area configured for contacting with the belt with friction, the anti-slip area is located in a middle area of the locking lever, and a gap for avoiding an edge of the belt is left between boundaries of both ends of the anti-slip area and inner walls of both sides of the body.

5. The belt buckle according to claim 3, wherein a plurality of bumps are distributed on a surface of the anti-slip area.

6. The belt buckle according to claim 3, wherein a plurality of racks extending along an axis of the locking lever are arranged on the surface of the anti-slip area, and the racks are arranged in parallel or cross each other.

7. The belt buckle according to claim 1, wherein the locking mechanism is arranged at a tail part, an end part or between the two parts of the body.

8. The belt buckle according to claim 2, wherein an end of the edge of the locking lever far from the rotating shaft is further provided with an operating part for manually toggling the locking lever to rotate around the rotating shaft; and the operating part is a convex part protruding from the outer surface of the adjusting part or a groove extending along the axis of the locking lever.

9. The belt buckle according to claim 1, wherein the outer surface is shaped such that when the adjusting part is at a rotation angle in which the outer surface is squeezing the belt, the engagement depth of the outer surface towards the blocking part is reduced by rotating the adjusting part in a direction such that a portion of the contact surface making contact with the belt moves away from the fixed end of the belt.

* * * * *